United States Patent [19]

Wynne

[11] 4,325,400

[45] Apr. 20, 1982

[54] FLUID FLOW EQUALIZING VALVE ARRANGEMENT

[76] Inventor: John R. Wynne, 10 Firtree Rd., Finchfield, Wolverhampton, West Midlands, England

[21] Appl. No.: 100,295

[22] Filed: Dec. 5, 1979

[30] Foreign Application Priority Data

Dec. 16, 1978 [GB] United Kingdom ..... 48814/78

[51] Int. Cl.[3] ..... F15B 11/02; F15B 13/06

[52] U.S. Cl. ..... 137/101; 137/111; 137/118; 91/515

[58] Field of Search ..... 137/101, 111, 118; 91/532, 515, 461, 165, 166; 60/420, 421

[56] References Cited

U.S. PATENT DOCUMENTS

| | | | |
|---|---|---|---|
| 2,460,774 | 2/1949 | Trautman | 137/101 |
| 2,466,485 | 4/1949 | Schultz | 137/101 |
| 2,593,185 | 4/1952 | Renick | 137/101 |
| 2,643,664 | 6/1953 | Willett | 137/101 |
| 2,956,577 | 10/1960 | Kirkham | 137/101 |

*Primary Examiner*—William R. Cline

*Attorney, Agent, or Firm*—Trexler, Bushnell & Wolters, Ltd.

[57] ABSTRACT

A fluid flow equalizing valve has two coupled valve devices for controlling flow to or from a common connection to respective ones of a pair of actuators. Control elements of the valve devices are responsive to intermediate pressures in flow paths to or from the actuators, and move in unison to reduce any difference in the intermediate pressures, and thereby to maintain the flows to or from the respective actuators substantially equal.

6 Claims, 1 Drawing Figure

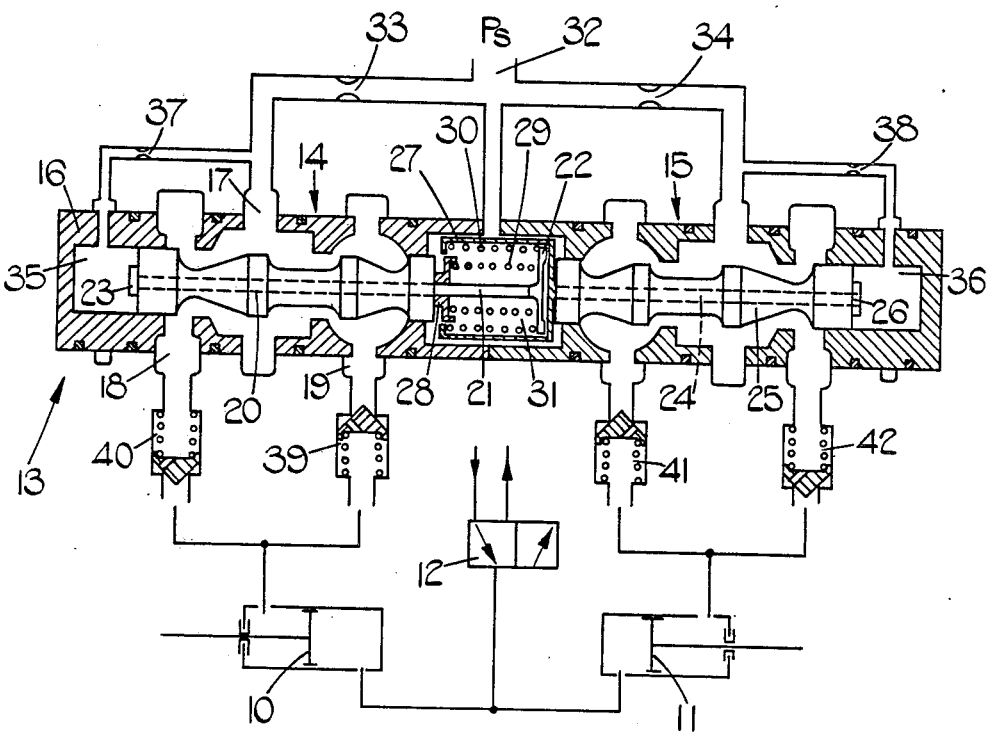
33
Ps
32
34
37
38
16
17
14
27
30
29
22
15
35
23
36
26
18
20
19
28
21
31
24
25
13
40
39
41
42
12
10
11

FLUID FLOW EQUALIZING VALVE ARRANGEMENT

BACKGROUND OF THE INVENTION

This invention relates to fluid flow equalizing valve arrangements for providing substantially equal fluid flow rates in each of two fluid flow paths.

In a fluid powered arrangement which has two elements which are required to be moved in unison, it is frequently more convenient that each element shall be operated by a separate fluid powered actuator, instead of interconnecting these elements directly. Where identical separate actuators are provided it is necessary that the rates of flow of operating fluid to these actuators shall be identical.

In some fluid powered arrangements, as for example the thrust deflectors on gas turbine engines, it is required that the two fluid powered elements shall move in unison at a first speed in one direction and at a different speed in the other direction. It is an object of the present invention to provide a valve which can control two substantially equal first levels of flow in one direction and two substantially equal second levels of flow in the opposite direction.

It may also be required that the valve arrangement shall act to limit flows in both directions, the flow limit in the first direction being different from that in the second direction. It may further be required that in the event of one of the aforesaid actuators seizing the supply to the other actuator is shut off. A particular embodiment of the present invention provides the aforesaid flow-limiting and shut-off functions.

SUMMARY OF THE INVENTION

According to the invention a fluid flow equalizing valve arrangement comprises first and second valve devices, each said device having first, second and third ports and a control element movable to increase or decrease flow in a flowpath which includes said first and second ports and simultaneously to decrease or increase flow in a flowpath which includes said first and third ports, coupling means operatively interconnecting said control elements for movement in unison, means for connecting said first ports to zones of equal fluid pressure, and means, responsive to a difference between an intermediate pressure in a flow path through said first valve device and the corresponding intermediate pressure in a flow path through the second valve device, for urging said control elements in a direction to reduce a difference between said intermediate pressures.

In a further preferred embodiment said coupling means comprises spring means for biasing said control elements towards a predetermined relative position.

In another embodiment said means responsive to the pressure difference comprises first surfaces on the respective control elements, said surfaces being exposed to respective ones of said intermediate pressures.

A particular embodiment includes means for applying a biasing fluid pressure to second surfaces on each of said control elements to urge said control elements in directions opposite to those in which they are urged by said intermediate pressures.

BRIEF DESCRIPTION OF THE DRAWING

An embodiment of the invention will now be described by way of example only and with reference to the accompanying drawing which shows, diagrammatically, a fluid powered actuator system incorporating a valve arrangement according to the invention.

DESCRIPTION OF A PREFERRED EMBODIMENT

A pair of identical actuator pistons 10, 11 are arranged to impart simultaneous movement to respective elements of an external apparatus (not shown). One side of each of the pistons 10, 11 is subjected to a pressure which may be either a supply pressure Ps or a low return pressure Pr, the pressure applied being controlled by a valve 12. The other sides of the pistons 10, 11 is subjected to a biasing pressure, which may also be the supply pressure Ps. The rods of the pistons 10, 11 provide differential areas on opposite sides thereof, to effect movement when both sides are subjected to the pressure Ps. The biasing pressure is applied to the pistons 10, 11 through a valve arrangement 13 according to the invention, the rates of movement of the pistons 10, 11 in either direction being dependent on the rates of fluid flow through the valve arrangement 13. The valve arrangement 13 comprises two identical valve devices 14, 15, the device 14 now being described in detail.

The device 14 includes a housing 16 having a first port 17 and second and third ports 18, 19. A control element 20 is slidable in the housing 16 to provide simultaneous control of fluid flow in a first flow path which includes the ports 17, 18 and a second flow path which includes the ports 17, 19. The configuration of the control element 20 is such that movement thereof which would permit an increase or a decrease in fluid flow between the ports 17, 18, would cause a simultaneous decrease or increase in fluid flow between the ports 17, 19.

A stem 21 has a flange 22 and extends slidably through the control element 20. A further flange 23 on the stem 21 retains the element 20 captive on the stem 21. A further stem 24 extends slidably through the control element of the valve device 15. The control element 25 is retained on the stem 24 between a flange 26 and a generally cylindrical cage 27 which surrounds the end of the stem 21 which supports the flange 22. A collar 28 is slidable on the stem 21 and a compression spring 29 is engaged between this collar and the flange 22. A further compression spring 30 is engaged between the flange 22 and a remote end of the cage 27.

The flange 22, the cage 27, the collar 28 and the springs 29, 30 lie in a chamber 31 sealingly separated from the valve devices 14, 15 by portions of the respective control elements 20, 25.

The port 17 and the corresponding port of the device 15 communicate with a source 32 of the supply pressure Ps by way of respective identical flow restrictions 33, 34. The source 32 also communicates with the chamber 31.

The ends of the control elements 20, 25 remote from the chamber 31 are exposed to the pressures in respective valve compartments 35, 36. The compartment 35, communicates with the inlet 17 by way of a flow restrictor 37, and the compartment 36 communicates with the corresponding inlet of the valve device 15 by way of a flow restrictor 38.

Fluid displaced by movement of the piston 10 flows to the port 18 through a non-return valve 39.

Fluid from the port 19 can flow to displace the piston 10, by way of a non-return valve 39. Fluid displaced by the piston 10 can flow to the port 18 by way of a non-return valve 40. Fluid flow to and from the piston 11 is by way of corresponding non-return valves 41, 42.

In use, the pressure Ps can be applied to the pistons 10, 11 by means of the valve 12. Fluid displaced by the piston 10 passes along the flow path which includes the non-return valve 40, the ports 18, 17 and the restrictor 33. Fluid displaced by the piston 11 passes along the flow path which includes the non-return valve 42 and the restrictor 34. The pistons 10, 11 will thus move at the same speeds if the rate of flow through these two paths are equal. Since the valve devices 14, 15 are identical, when the flows are equal the pressure at the port 17 of the valve device 14 will be equal to that at the corresponding port of the valve device 15. The pressures in the compartments 35, 36 will be equal and the elements 20, 25 will not therefore move from the positions shown in the drawing.

If, for example, the flow through the port 17 exceeds that through the corresponding port in device 15, the pressure in port 17 will rise, and the pressure in compartment 35 will exceed that in compartment 36. The pre-loading of the springs 29, 30 is such that provided the pressures in the compartments 35, 36 do not differ from the pressure Ps in the chamber 31 by more than predetermined amounts, these springs do not compress. In these circumstances, the aforesaid increase in pressure in compartment 35 causes both the elements 20, 25 to move rightwardly in unison and thereby simultaneously to decrease flow through the port 18 and increase flow through the corresponding port in the valve device 15. Movement of the control elements ceases when the pressures in compartments 35, 36 are equal, that is when the flow rates through the two flow paths are equal. It will be apparent that if the displacement flow of the piston 11 exceeds that of the piston 10, the elements 20, 25 will move leftward until these flows are again equal.

When the valve 12 is moved to subject one side of each of the pistons 10, 11 to the return pressure Pr, the other side of these pistons are subjected to the supply pressure Ps through the valve arrangement 13 and the respective non-return valve 39, 41. If the flow through the flow path including the restrictor 33, ports 17, 19 and valve 39 is greater than that through the corresponding flow path in the valve device 15, the pressure at port 17 will be lower than that of the corresponding port in device 15. The resultant higher pressure in compartment 36, will move the elements 20, 25 leftward to decrease flow between the ports 17, 19 this movement ceasing when the pressures, and hence the flow rates are again equal.

If the rate of flow displaced by the pistons 10, 11 through the valve arrangement 13 exceeds a predetermined amount, the pressures in the compartments 35, 36 will exceed the pressure Ps in the chamber 31 by an amount which causes the spring 29 to compress. The elements 20, 25 will thus move towards one another and simultaneously reduced both flows, thereby limiting the rate of piston movement. If fluid flow from the source 32 through the valve arrangement 13 to the pistons 10, 11 exceeds a predetermined amount, the pressures in the compartments 35, 36 will fall below the pressure Ps in chamber 31 by an amount which will cause the spring 30 to compress, allowing the elements 20, 25 to move apart and simultaneously reduce flows to the pistons 10, 11. The pre-loading of the springs 29, 30 permits different flow rates, and hence piston speeds, to be set for each direction of piston movement.

Additionally, the valve arrangement is responsive to the pressure differences arising in the event that movement of one of the pistons 10, 11 is arrested due to malfunction, the valve arrangement acting to shut off flow to or from both pistons. Should, for example, the piston 10 or its associated external apparatus seize there will be no flow in either direction through the valve device 14. The pressure in compartment 35 will thus be equal to that in chamber 31 and the control element 20 will offer no resistance to movement of the control element 25. Any flow through the valve device 15 will produce a pressure difference acting on control element 25 so that the element 25 will move unopposed to shut off flow through the element 15. Jamming or seizure of the piston 10 will thus result in arrest of the piston 11. It will be apparent that jamming or seizure of the piston 11 has a similar effect in arresting movement of the piston 10.

I claim:

1. A fluid flow equalizing valve arrangement comprising first and second valve devices, each said device having first, second and third ports and a control element movable to increase or decrease flow in a flow path which includes said respective first and second ports and simultaneously in an opposite sense to decrease or increase flow in a path which includes said respective first and third ports, coupling means for operatively inter-connecting said control elements for movement in unison in respective opposite directions to increase or decrease flow in a first flow path through one of said valve devices and to decrease or increase flow in a corresponding second flow path through the other of said valve devices, means for connecting said first ports to a fluid pressure source, means for providing first and second intermediate pressures respectively dependent upon the flows in said first and second flow paths, first and second actuator means responsive to said first and second intermediate pressures respectively, said first and second actuator means being operable to urge said control elements in unison in respective ones of said opposite directions, said coupling means including resilient biasing means for urging said first and second elements to a predetermined relative position and for permitting relative movement between said elements when the pressure on either of said actuators exceeds a predetermined value.

2. A valve arrangement as claimed in claim 1 which includes a flow restriction in each of said flow paths.

3. A valve arrangement as claimed in claim 2 in which said flow restriction comprises a restriction in each of said connecting means.

4. A valve arrangement as claimed in claim 1 in which said biasing means comprises a first spring for biasing said elements in a first direction of relative movement and a second spring for biasing said elements in a second direction of relative movement.

5. A valve arrangement as claimed in claim 1 in which each said actuator means comprises first and second surfaces on said first and second elements, said first surfaces being subjected to said intermediate pressures and said second surfaces being subjected to a reference pressure.

6. A valve arrangement as claimed in claim 5 in which said reference pressure is derived from said pressure source.

* * * * *